US005101134A

United States Patent [19]

Rothwell, Jr. et al.

[11] Patent Number: 5,101,134

[45] Date of Patent: Mar. 31, 1992

[54] LOW WATTAGE METAL HALIDE CAPSULE SHAPE

[75] Inventors: Harold L. Rothwell, Jr., Georgetown, Mass.; Betina Desmarais, Exeter, N.H.

[73] Assignee: GTE Products Corporation, Danvers, Mass.

[21] Appl. No.: 588,405

[22] Filed: Sep. 26, 1990

[51] Int. Cl.[5] ..... H01J 1/02; H01J 7/24; H01J 61/30

[52] U.S. Cl. ..... 313/44; 313/25; 313/634

[58] Field of Search ..... 313/634, 25, 44, 573

[56] References Cited

U.S. PATENT DOCUMENTS

| | | | |
|---|---|---|---|
| 2,104,652 | 1/1938 | Inmay | 313/25 |
| 2,130,304 | 9/1938 | Lemmers | 313/25 |
| 2,896,107 | 7/1959 | Anderson | 313/634 |
| 4,594,529 | 6/1986 | de Vrijer | 313/634 |

*Primary Examiner*—Donald J. Yusko
*Assistant Examiner*—Nimeshkumar D. Patel
*Attorney, Agent, or Firm*—William E. Meyer

[57] ABSTRACT

A low wattage metal halide capsule shape having a cylindrical shape geometry with asymmetrical regions behind the anode and cathode for direct current operation is disclosed. The disclosure concerns several arc tube geometries to encourage internal convective flow in small, direct current arc discharge lamps.

14 Claims, 3 Drawing Sheets

LOW WATTAGE METAL HALIDE CAPSULE SHAPE

TECHNICAL FIELD

The invention relates to electric lamps and particularly to arc discharge electric lamps. More particularly the invention is concerned with the geometry of miniature arc discharge lamp capsules.

BACKGROUND ART

Effort is being made to improve automobile headlamps by making headlamps with small cross sections to reduce wind resistance and thereby enhance vehicle mileage. By generating light more efficiently, electrical demands may also be reduced, again enhancing mileage. By increasing lamp durability, vehicle maintenance, and warranty service costs are also reduced. A reduced light source size may also enhance optical accuracy in forming a projected beam. Light quality may then be improved, enhancing vision, without increasing glare or stress to oncoming drivers. All of these advantages may be achieved with a low wattage arc discharge headlamp. Low wattage arc discharge lamps, however, are not sufficiently well developed to be quickly adapted to vehicle use. Further development of arc discharge lamps is needed to make a practical vehicle lamp. In particular, there is a need for an arc lamp envelope shape for direct current operation, minimal warmup time, and horizontal operation to produce about 70 lumens per watt at about 30 or 35 Watts.

Different electrode structures have been investigated in search of a proper design for direct current operation. Merely adjusting electrode shapes has not produced the features needed in a practical vehicle lamp. The shape of the capsule must also be adjusted, particularly in the region adjacent the cathode, the negative electrode. The cathode end of the arc produces a larger portion of the light, and is therefore placed at or near the focal point of a reflector. Variations in the arc dynamics, particularly those adjacent the cathode, then have a substantial affect on the beam. Proper placement of the cathode, and its interaction with the envelope are therefore recognized as important to overall beam quality. Placement of the anode, and the interaction with the adjacent lamp wall is less critical for photometric performance, but still essential for proper heat transfer.

Examples of the prior arc discharge lamp art are shown in U.S. Pat. No(s). 3,259,777; 4,161,672; 4,170,746; 4,396,857; 4,594,529 and 4,779,026.

Elmer Fridrich U.S. Pat. No. 3,259,777 issued July 5, 1966 for Metal Halide Vapor Discharge Lamp with Near Molten Tip Electrodes shows tubular shaped arc discharge lamps. FIGS. *2a*, *3a*, 4 and 5 show small tubular lamps Daniel Cap et al. U.S. Pat. No. 4,161,672 issued on July 17, 1979 to for High Pressure Metal Vapor Discharge Lamps of Improved Efficacy discusses the shapes and electrode penetrations of lamps of less than 250 watts. In particular, Cap discloses a 30 watt ellipsoidal lamp with an internal volume of 0.066 $cm^3$ having a diameter of 3.5 millimeters, and a length of 4.5 millimeters. Cap is concerned with nearly spheroidal to elongated spheroids in combination with electrodes inserted from 4.55 to 18.75 percent of the long diameter.

John Davenport U.S. Pat. No. 4,170,746 issued on Oct. 9, 1979 for High Frequency Operation of Miniature Metal Vapor Discharge Lamps discusses the operation of spherical lamps with 3.2, 4.0, 5.0, 6.0, and 7.0 millimeter internal diameters operated at different alternating current frequencies.

George Danko U.S. Pat. No. 4,396,857 issued on Aug. 2, 1983 for Arc Tube Construction shows a miniature discharge tube having a volume from 0.1 to 0.15 $cm^3$. Danko claims the use of cylindrical solid neck portions adjacent the bulbous central volume. The cylindrical neck portions help assure a surface of revolution around the longitudinal axis of the lamp.

Bertus de Vrijer U.S. Pat. No. 4,594,529 issued on June 10, 1986 for Metal Halide Discharge Lamp discloses a miniature tubular arc discharge lamp. de Vrijer is concerned with the tubular dimensions of a lamp for use as a headlamp.

Jurgen Heider U.S. Pat. No. 4,779,026 issued on Oct. 18, 1988 for Rapid Start High Pressure Discharge Lamp and Method of Its Operation shows a miniature arc discharge lamp with a tubular body, and slightly pinched transitions between the seals and bulb region. Heider discusses lamps with volumes less than 0.03 $cm^3$.

DISCLOSURE OF THE INVENTION

A low wattage, direct current, horizontally operated, metal halide capsule may be improved by forming the anode region to enhance convective currents, and forming the cathode region to be exposed to the convective currents In a preferred embodiment, a low wattage, direct current, metal halide capsule may be formed as a generally cylindrical lamp capsule with a light transmissive material having an external wall defining a small enclosed volume. The anode end and cathode end are asymmetrically formed to encourage differing thermal gradients, and thereby enhance convective flow. The preferred anode end has a conical form to enhance convective flow, while the preferred cathode end has a hemispherical form to expose its surface to convective flows. The enhanced convective flow is felt to counteract cataphoresis, and help sustain adequate dopant concentration in the arc. A cathode electrode is positioned axially in a cathode seal end of the lamp capsule, having a first contact end, an intermediate seal portion sealed to the capsule wall, and a second exposed internal end extending in the enclosed volume. A similar anode electrode is positioned axially in an anode seal end of the lamp capsule, having a first contact end, an intermediate seal portion sealed to the capsule wall, and a second exposed end extending in the enclosed volume. A lamp fill is also positioned in the enclosed volume, excitable to light emission when electricity is applied to the first contact end of the anode and the first contact end of the cathode. The regions behind each electrode are particularly important for the design of a direct current metal halide discharge lamp. Each electrode end of the enclosed volume is shaped to optimize overall performance.

BEST MODE FOR CARRYING OUT THE INVENTION

Figure 1:
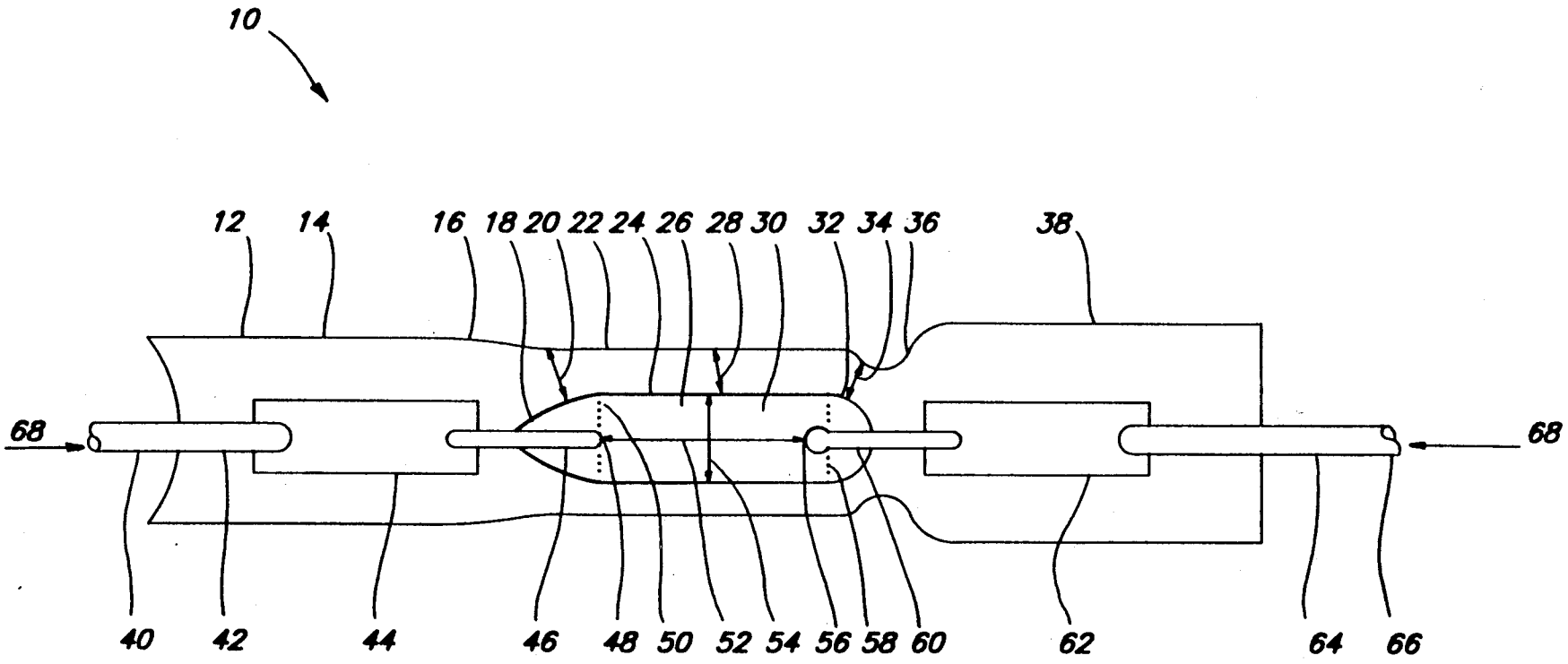
FIG. 1 shows in cross section a preferred embodiment of a low wattage metal halide capsule shape with a tubular midsection.

At the anode, the primary consideration in an arc discharge lamp design is heat dissipation. In the preferred lamp capsule embodiment, the lamp capsule is operated horizontally, and the capsule wall adjacent the anode is approximately concentric and conical with an angle of about 45 degrees to the anode. A slightly conical inner geometry was found to increase the amount of quartz near the anode root and thereby improved heat conduction from the anode. At the same time the conical form is felt to reduce the heat content in the adjacent lamp fill, thereby contributing to a convective flow that spreads across the envelope top. For direct current operation the fairly sharp angle between the conical section and the coaxially positioned anode root can be advantageous in contrast to an alternating current discharge where the sharp corner regions may stagnate gas flow. A highly acute angle between the anode and the capsule wall may trap chemical dose components and stagnate the fill material flow. A highly obtuse angle between the anode and the capsule wall may not transfer sufficient heat to the capsule wall. The preferred conical anode end of the enclosed volume is therefore felt to enhance the heat driven convective flow in a horizontally operated lamp. The enhanced flow extends through the enclosed volume to the cathode where condensed materials are more quickly swept into the convective flow.

At the cathode, the primary considerations in arc discharge lamp design are to conserve heat and to control gas convection behind the electrode. Heat loss through the capsule reduces the energy for light production. Poor gas convection allows additives to condense on the capsule or electrode root, thereby reducing their concentration in the arc. The preferred construction uses a thinned wall opposite the cathode to reduce heat conduction to the cathode seal end. The preferred surface is smooth, and otherwise exposed to convective gas flow. In one embodiment, the cathode seal end is indented to thin the amount of quartz and reduce heat conduction from the cathode root to the cathode end seal. The conserved heat helps locally heat the fill gas to enhance a vertical flow around the cathode. In addition, the indentation may help form a smooth rounded region near the cathode root. The smooth internal envelope surface improves gas convection across the metal halides or similar condensates that form on the envelope wall adjacent the cathode root. The improved convection stemming from the anode end shape then sweeps around the cathode to help vaporizes the condensed materials more efficiently. A hemispherical cathode end has been found to provide the desirable smooth, exposed surface. Other surfaces approximating a hemisphere may be used.

The internal surfaces of the enclosed volume adjacent the anode and cathode roots are important since direct current cataphoretic pumping of the metal halide dominates both gas convection and cold spot temperature in controlling condensate location. Cataphoretic pumping action occurs on the cathode, the negative electrode. For a direct current light source, cataphoretic pumping is always in one direction and particular care must be taken to avoid small envelope geometries, such as sharp angles, that can trap the metal halide condensate, and starve the arc.

The shape of the midsection of the capsule is considered less critical. The midsection may be cylindrical, being initially formed from a quartz tube. The midsection may also have the form of a symmetric, and diametric section of an ellipsoid or spheroid provided the axial curvature of the section is small. The preferred tubular shape for the midsection is then well approximated by the slight barrel shape. High curvatures necessarily lead to a large intersection angle between the midsection and the anode root, thereby producing symmetric heat structures at each end thereby producing equal thermal gradients that frustrate convective flow. In combination the conical anode end, tubular or barrel midsection and hemispherical cathode end give a tear shaped enclosed volume.

FIG. 1 shows in cross section a preferred embodiment of a low wattage, horizontally operated metal halide capsule shape with a tubular midsection. The low wattage metal halide lamp 10 is assembled from a lamp capsule 12, a lamp fill 30, an anode 40, and a cathode 66 to be operated generally horizontally along an axis 68.

The lamp capsule 12 may be formed from a light transmissive material such as quartz or glass. In the preferred embodiment the lamp capsule 12 has an anode seal end 14, leading by an anode neck 16 with an anode neck thickness 20. The anode seal end 14 necessarily acts as a heat sink which draws energy from the lamp. The anode neck 16 is then designed to enhance heat flow to the anode seal end 14 from an anode root 46. Adjacent the anode neck 16 is a midsection 22 with an internal surface 24 defining an enclosed volume 26. Midsection 22 has the general form of an object of rotation, with a wall thickness 28. The midsection 22 extends to a cathode neck 36, leading to a cathode seal end 38.

In the preferred embodiment, the enclosed volume 26 has an overall length to widest width ratio of about 2.7. The enclosed volume 26 for the low wattage are discharge capsule has a volume of less than 0.1 $cm^3$, and preferably less than about 0.05 $cm^3$. In one example, a capsule 12 with an enclosed volume of 0.020 $cm^3$ was found to work quite well. The capsule 12 should have a wall thickness 28, as measured along the midsection 22 and as the shortest distance between the outer surface and internal surface 24 sufficient to conduct enough heat from the wall area to the anode seal end 14, and cathode seal end 36, such that in combination with radiation, and convection from the lamp surface, the capsule 12 temperature is maintained somewhat below the softening point of the capsule material. The preferred wall thickness is not scaled linearly with respect to larger lamps, but is somewhat thicker for the small volume. The object is for the capsule 12 to reach the highest possible temperature that the capsule material may endure for a sustained period with minimal material degradation. The coldest spot along the internal volume should be hot enough to adequately vaporize the salt condensates, which is generally about 750° C. Similarly, the hottest point should not exceed the softening point of the envelope material given the pressure of operation. A lamp may otherwise be operated within these temperature limits. A higher temperature in the limits is usually more efficient, but is destructive to the lamp and shortens the lamp's life. A lower temperature in the limits is less efficient in producing lumens per watt, but the lamp lasts longer. A lower temperature also contributes to inefficient salt condensate coverage which may prolong warmup time at constant wattage.

For a capsule 12 with a volume of 0.02 $cm^3$, the preferred wall thickness 28 is about 1.5 millimeters.

The capsule 12 geometry is important in maximizing lamp efficiency and lamp warmup times. The preferred capsule 12 has an internal surface 24 with an approximately conical anode end 18, an approximately tubular midsection 22, and an approximately hemispherical cathode end 32. The conical anode end 18 has a preferred half angle of about 45 degrees from the lamp axis 68 to one side, or equivalently, providing about a 90 degree angle from side to side. The cone base 50 of the conical anode end 18 is approximately transverse to the lamp axis 68 and coplanar with the anode tip 48. The relevant features of the conical anode end 18 are thought to be that the anode tip 48 is positioned relatively far from the internal surface 24, while the inner surface 24 is near the length of the anode root 46 for heat conduction from the anode root 46.

Figure 2:
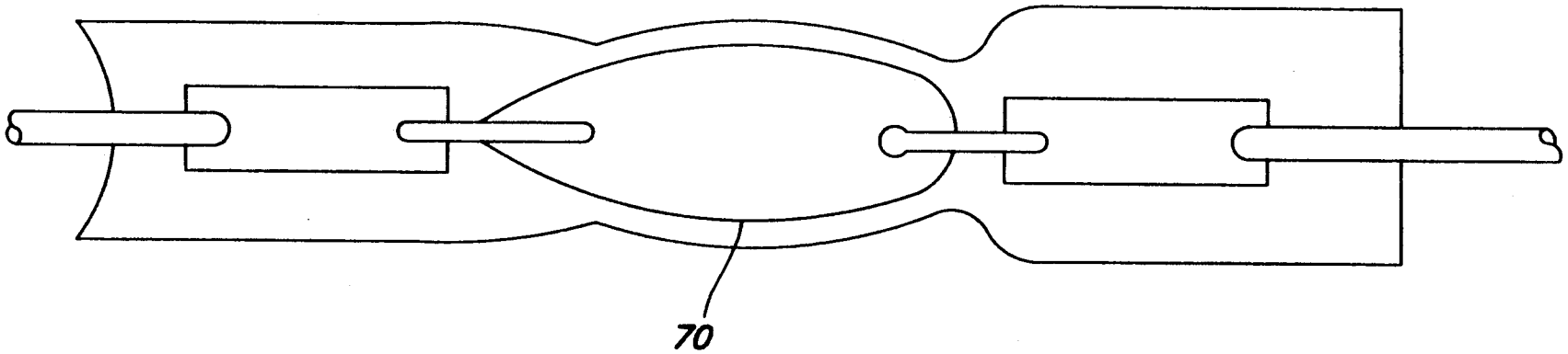
FIG. 2 shows in cross section an alternative preferred embodiment of a low wattage metal halide capsule shape with a spheroidal section midsection.
Figure 3:
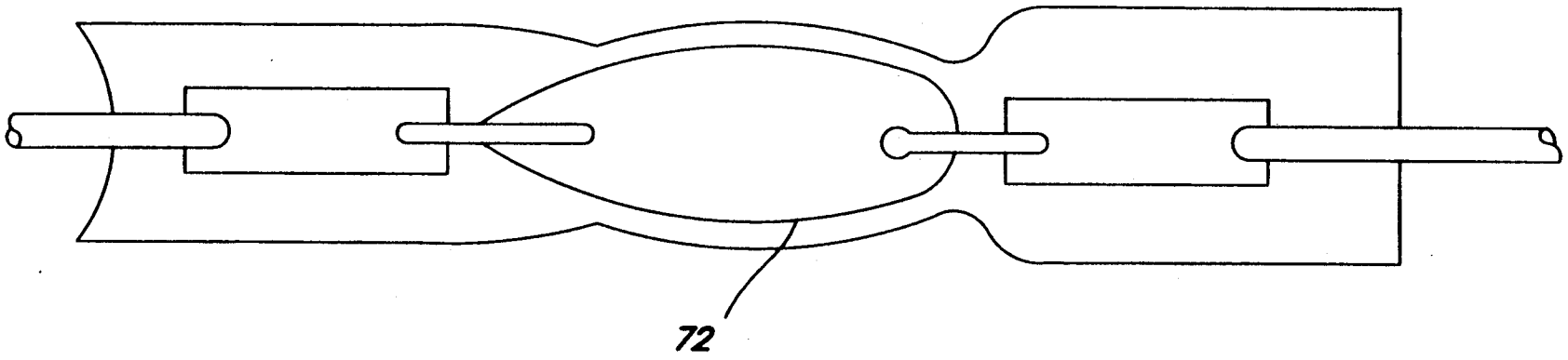
FIG. 3 shows in cross section an alternative preferred embodiment of a low wattage metal halide capsule shape with an ellipsoidal section midsection.

The midsection 22 of the preferred internal surface 24 has a cylindrical form. A coaxial section of a spheroid, or ellipsoid may also be used. FIG. 2 shows a capsule with a spheroidal midsection 70, and FIG. 3 shows a capsule with an ellipsoidal midsection 72. The axial length 52 of the midsection 22 determines the anode tip 48 to cathode tip 56 separation, and is preferably about 4.0 millimeters or about one and a half times the diameter D of 2.6 millimeters. The relevant features are thought to be that the midsection 22 be a surface of rotation with respect to the lamp axis 68, and have little or no curvature in the axial direction. Tubular, or slightly barrel shaped internal surfaces are then preferred.

The preferred hemispherical cathode end 32 has nearly the diameter of the midsection 22, and is positioned so the cathode tip 56 is the center of a sphere tangent on one half with the hemispherical end 32. The diametric base 58 of the hemispherical end 32 is approximately transverse to the lamp axis 68 and coplanar with the cathode tip 56. The relevant features of the hemispherical end 32 are thought to be that the internal surface 24 adjacent the cathode root 60 is smooth, and the cathode tip 56 be positioned maximally far from the internal surface 24. The cathode root 60 near the inner surface 24 remains as hot as possible. By being hot, smooth and open the cathode end structure encourages vertical gas convection to vaporize condensates on the cathode end 32.

The preferred capsule 12 has essentially tubular geometry with a minor internal diameter D 54 of about 2.6 millimeters, a major internal diameter or length L of about 7.1 millimeters giving an aspect ratio L/D of 2.72. By way of example the capsule 12 is shown as a cylinder with asymmetrical regions behind the anode and cathode. The important features are felt to be the relatively large standoff between the anode tip 48, and the adjacent internal surface 24, in combination with the relatively extended internal anode tip 48 to cathode tip 56 length 52, as is provided in a cylindrical or prolate spheroid capsule. The asymmetrical regions behind the anode tip 48 and cathode tip 56 enhance differing thermal gradients, and thereby encourage horizontal convective flow.

The capsule 12 supports in the anode seal end 14 an anode 40. The preferred anode 40 has an anode contact 42, an intermediate anode seal 44, and an exposed anode tip 48. The preferred anode 40 is positioned coaxially to pass from the exterior of the capsule 12 through the anode seal end 14 to the enclosed volume 26. The anode contact 42 is then exposed on the capsule exterior to receive electricity. The anode seal 44 is sealed to the anode seal end 14, and the anode tip 48 is positioned in the enclosed volume 26. In the preferred embodiment the anode tip 48 extends axially into the enclosed volume 26 a distance X approximately the same distance as the anode 40 tip is from the internal surface 24. Since the adjacent conical anode end 18 is approximately at 45 degrees to the anode, the transverse distance from the anode tip 48 to the inside surface is about the diameter D divided by two times the square root of two. The anode tip 48 extension aspect, X/D is then about 0.5. In the preferred embodiment, the anode tip 48 is then positioned as a center point in a coaxial conical end 18 of the enclosed volume 26. The inside surface 24 intersects the anode root 46 to leave an acute angle in the enclosed volume 26. By way of example an anode 40 is shown as an exterior rod coupled to a sealing foil, which in turn is coupled to a straight rod with a rounded tip that extends into the enclosed volume 26. Other electrode sealing, and electrode tip structures are known and may be adapted for use in the present design.

The capsule 12 supports in a cathode seal end 38 the cathode 66. The cathode 66 has a cathode tip 56, a cathode root 60, a cathode seal 62, and an exposed cathode contact 64. In the preferred embodiment the cathode tip 56 end is positioned axially into the enclosed capsule volume a distance Y approximately the same distance as the cathode tip 56 is from the inside wall of the capsule. Since the enclosed volume 26 is approximately cylindrical, the transverse distance from the cathode tip 56 to the inside surface is about one half the diameter, D/2. The cathode 58 extension aspect, Y/D is then about 0.5. In the preferred embodiment, the cathode 56 tip is then positioned as a center point in a sphere whose surface on one side is approximately tangent to the hemispherical cathode end 32 of the enclosed volume 26. More conventionally, the surface of the enclosed volume 26 at the cathode end is approximately hemispherical about the cathode tip. The inside surface of the enclosed volume 26 then intersects the cathode root 60 approximately perpendicularly. The cathode 66 is positioned to pass from the enclosed volume 26 through the cathode seal end 38 to the exterior to receive electricity. By way of example a cathode 66 Is shown as an exterior rod coupled to a sealing foil, which in turn is coupled to a straight rod with a rounded tip that extends into the enclosed volume 26. Other cathode sealing, and cathode tip structures are known and may be adapted for use in the present design.

Lamp fills 30 for arc discharge lamps are known to have a carrier gas such as neon, argon, krypton, or xenon, and a variety of additives such as mercury, scandium, iodine, and others. Numerous lamp fills are thought to be appropriate for the present lamp envelope structure. The preferred lamp fill 28 is a mercury, sodium scandium iodide ($NaScI_4$) fill in eight atmospheres of xenon. Other suitable compositions may be used.

Alternative embodiments of the tear shaped arc discharge lamp are shown in FIG. 2 and FIG. 3. FIG. 2 shows in cross section an alternative preferred embodiment of a low wattage metal halide capsule shape with a spheroidal section midsection. FIG. 3 shows in cross section an alternative preferred embodiment of a low wattage metal halide capsule shape with an ellipsoidal section midsection.

The preferred method of manufacturing the tear shaped arc discharge lamp is to first, simultaneously press seal and pressure mold the cathode end. Press sealing, seals the cathode in place, while pressure molding expands the enclosed volume 26 around the cathode root to an approximately hemispherical end. Accurate placement of the cathode, and formation of the adjacent cathode end may then be achieved in one operation. The pressure molding can also form the middle section in an expanded cylindrical, spherical, ellipsoidal or similar section. The partially formed capsule is then purged of contaminants. Flushing the capsule volume with nitrogen is suggested. The metal halides, or other additives and fill gas are then positioned in the capsule volume. The gas fill is cryothermally condensed in the enclosed volume. An anode is positioned in the remaining open end of the capsule and vacuum sealed in place. Vacuum sealing substantially preserves the hemispherical cathode end, and cylindrical middle section, while collapsing the anode end of the capsule to seal with the anode. Vacuum sealing yields a conical shaped anode end adjacent the anode root.

Capsule warmup depends on interrelated factors. Warm up factors include capsule mass, input electrical power, fill gas composition, fill gas pressure, chemical dose composition, and chemical dose amount. Several volumes and wall thicknesses were evaluated to seek the minimum warmup time for a nearly constant input current. In general capsule wall thicknesses from approximately 0.4 to 1.5 millimeters, and capsule volumes from 0.02 to 0.1 cubic centimeters were examined. A minimum warmup was arbitrarily chosen to be the time required to reach 80% of full operating light output. The same ballast was used for all warmup time measurements for different envelope shapes.

The preferred lumen output was determined by the minimum number of lumens required for a legal headlamp. While some metal halide lamps may achieve more than 70 lumens per watt, the preferred lamp was not designed to maximize light generation. In an automotive headlamp, excess light may cause glare for oncoming vehicles, so only the required number of lumens should be produced. The arc discharge may be designed to be wall stabilized. Wall stabilization influences the brightness of the discharge. Wall stabilization is generally preferred for a vehicle lamp, since discharge movement is less pronounced. The light then does not flutter with arc motion as in electrode stabilization. Unfortunately, wall stabilized arcs cause high thermal loads on the inner walls. High thermal loads may soften, and reshape the envelope wall.

Initially, the lamps with the best warmup times were found to operate with the top portion of the lamp envelope wall at temperatures above 1100 degrees centigrade. These temperatures soften the envelope wall. The capsule shape was changed to satisfy horizontal operation and still maintain maximum wall temperatures below the degradation point of the capsule, about 1000 degrees centigrade for quartz. The primary designs are tabulated below showing the critical parameters.

TABLE 1

| TUBE SHAPE | ellipse | tear | ellipse | tear |
|---|---|---|---|---|
| TUBE SIZE | 2 × 4 | 2 × 4 | 2 × 5 | 2 × 5 |
| VOLUME (cc) | 0.096 | 0.039 | 0.076 | 0.020 |
| WALL (mm) | 0.61 | 0.89 | 1.0 | 1.5 |
| MINOR ID (mm) | 4.8 | 3.0 | 4.8 | 2.0 |
| MAJOR ID (mm) | 9.0 | 8.0 | 7.8 | 7.5 |
| WATTAGE | 30 | 30 | 30 | 30 |
| LUMENS PER WATT | 69 | 71 | 45 | 64 |
| RUN UP 50% (sec) | 18 | 7 | 22 | 32 |
| RUN UP 80% (sec) | 28 | 12 | 55 | 48 |
| WALL TEMP (C) | 1175 | 1100 | 1000 | 900 |

The term "ellipse" refers to an elliptical or football shaped capsule, and "tear" refers to a tear drop or tubular capsule with one end rounded and the opposite end more pointed The major difference in the several lamp shapes is wall thickness. By increasing wall thickness, thermal conduction is increased, thereby reducing the maximum wall temperature, but also reducing total lumens and increasing warmup time. By substantially decreasing the enclosed volume, the lumen output could be improved without increasing the wall temperature.

When the area of the internal wall covered by the metal halide condensate is increased, the condensate vaporizes more rapidly, thereby maintaining a higher concentration of the additives in the arc. The optimum design is felt to be described by a 2×5 tubular geometry with the anode end being formed to enhance convective flow, and the cathode end being formed to present condensate to the convective flow. The overall shape appearing "tear" shaped. The conical and hemispherical surfaces then help sustain the additive dose in the arc to maintain lamp performance.

In a working example some of the dimensions were approximately as follows: The capsule was about 32 millimeters long. The anode seal end was a vacuum seal 5.08 millimeters wide and about 11.5 millimeters long. The anode necked down area was about 1.5 millimeters long, and had an indentation of about 1.0 millimeters. The tubular midsection was about 3.98 millimeters long, with an outside diameter of 5.2 millimeters. The enclosed volume was 7.1 millimeters long and 2.6 millimeters in internal diameter The cathode necked down region was similar to the first, being about 1.0 millimeters long and having an indentation of about 1.0 millimeters. The cathode sealed end was about 9.5 millimeters long and 6.1 millimeters across.

Sealed in the first seal end was a cathode from a first input wire. The first input wire had a diameter of about 0.51 millimeters. The input wired entered the anode seal end and coupled to a first foil. The first foil had a length of 5.0 millimeters and width of 1.5 millimeters. The first foil was then coupled to a cathode. The cathode electrode extended into the enclosed volume to be exposed by about 1.5 millimeters in the enclosed volume. The opposite electrode, the anode was similarly exposed by about 1.5 millimeters in the enclosed volume. The anode entered the second seal area to couple with a second foil about 1.5 millimeters in width and 5.0 millimeters in length. Coupled to the opposite end of the second foil was a second lead wire with a diameter of about 0.51 millimeters extended. The second lead wire emerged from the second seal to be exposed for electrical connection. The enclosed volume included a fill lamp fill including mercury, sodium, scandium, iodine and about 8 atmospheres of xenon. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications may be made herein without departing from the scope of the invention defined by the appended claims.

What is claimed is:

1. A low wattage, direct current, horizontally operated metal halide capsule with an internal cavity comprising:

(a) a generally cylindrical capsule formed from a light transmissive material, with an internal wall defining an enclosed volume less than 0.1 $cm^3$, the wall having a cathode end open to convective flows in the enclosed volume, an intermediate band, and an anode end, asymmetric with respect to the cathode end shape to produce a differing thermal gradient with respect to the cathode end and thereby enhance convective flow in the enclosed volume, (b) an anode electrode, positioned axially in a first end of the capsule, having a first contact end, an intermediate seal portion sealed to the capsule wall, and a second exposed internal end extending generally coaxially through the anode end of the internal wall into the enclosed volume, (c) a cathode electrode, positioned axially in a cathode end of the capsule, having a first contact end, an intermediate seal portion sealed to the capsule wall, and a second exposed end extending coaxially through the exposed end of the internal wall into the enclosed volume, and (d) a lamp fill positioned in the enclosed volume, excitable to light emission on application of electricity to the first contact end of the anode and the first contact end of the cathode.

2. A low wattage, direct current, horizontally operated metal halide capsule with a tear shaped internal cavity comprising:

(a) a generally cylindrical capsule formed from a light transmissive material, with an internal wall defining an enclosed volume less than 0.040 $cm^3$, the wall having a cathode end open to convective flows in the enclosed volume, an intermediate band, and an anode end having a lower side to produce heat and thereby enhance convective flow in the enclosed volume, (b) a cathode electrode, positioned axially in a first end of the capsule, having a first contact end, an intermediate seal portion sealed to the capsule wall, and a second exposed internal end extending generally coaxially through the convective flow stimulating anode end of the internal wall into the enclosed volume, (c) a cathode electrode, positioned axially in a cathode end of the capsule, having a first contact end, an intermediate seal portion sealed to the capsule wall, and a second exposed end extending coaxially through the exposed end of the internal wall into the enclosed volume, and (d) a lamp fill positioned in the enclosed volume, excitable to light emission on application of electricity to the first contact end of the anode and the first contact end of the cathode.

3. A low wattage, direct current, horizontally operated metal halide capsule with a tear shaped internal cavity comprising:

(a) a generally cylindrical capsule formed from a light transmissive material, with an internal wall defining an enclosed volume less than 0.040 $cm^3$, the wall having a generally hemispherical cathode end, an intermediate band, and a generally conical anode end, (b) an anode electrode, positioned axially in the anode end of the capsule, having a first contact end, an intermediate seal portion sealed to the capsule wall, and a second exposed internal end extending generally coaxially through the conical anode end of the internal wall into the enclosed volume, (c) a cathode electrode, positioned axially in a cathode end of the capsule, having a first contact end, an intermediate seal portion sealed to the capsule wall, and a second exposed end extending coaxially through the hemispherical end of the internal wall into the enclosed volume, and (d) a lamp fill positioned in the enclosed volume, excitable to light emission on application of electricity to the first contact end of the anode and the first contact end of the cathode.

4. The capsule in claim 1, wherein the cathode end of the internal wall is approximately hemispherical.

5. The capsule in claim 4, wherein an end structure of the cathode electrode is approximately coplanar with a plane transverse to the lamp axis to define a diametric plane of the hemispherical end of the internal wall.

6. The capsule in claim 1, wherein the anode end of the internal wall is approximately conical.

7. The capsule in claim 6, wherein the tip of the anode electrode is approximately coplanar with a plane defining a base of the conical end of the internal wall.

8. The capsule in claim 1, wherein the intermediate band has a wall thickness of less than 2.0 millimeters.

9. The capsule in claim 1, wherein the intermediate band has a tubular form with an approximately constant internal diameter.

10. The capsule in claim 1, wherein the intermediate band has a spherical section form with an approximately constant curvature.

11. The capsule in claim 1, wherein the intermediate band has an elliptical section form.

12. A low wattage, direct current, horizontally operated, metal halide capsule comprising:

(a) a generally cylindrical capsule formed from a light transmissive material, having a wall with a wall with a thickness of less than 2.0 millimeters, defining an enclosed volume of less than 0.020 $cm^3$ with a transverse internal diameter of about 2.0 millimeters, an axial internal diameter of about 7.5 millimeters, the wall having a generally hemispherical shaped cathode end, an intermediate band, and a generally conical shaped anode end, (b) an anode electrode, having a first contact end externally exposed for electrical connection, an intermediate seal portion coupled to the capsule, and a second internal end exposed in the enclosed volume, coaxially positioned in the conical shaped anode end, (c) a cathode electrode, having a first contact end externally exposed for electrical connection, an intermediate seal portion coupled to the capsule, and a second internal end exposed in the enclosed volume, coaxially positioned in the hemispherical shaped cathode end, and (d) a metal halide lamp fill excitable to light emission on application of electricity to the first contact end of the anode and the first contact end of the cathode.

13. The capsule in claim 6, wherein an angle formed between the exposed internal end of the anode and the adjacent conical, anode end of the internal wall is approximately forty-five degrees.

14. The capsule in claim 1, having a major internal diameter (L) measured between the respective positions where the anode and cathode extend respectively through the anode and cathode ends of the internal wall, and a minor internal diameter (D) measured transverse to the center of the major diameter, wherein the ratio (L/D) of the major internal diameter to the minor internal diameter is approximately 2.7.

* * * * *